US010710260B2

(12) United States Patent
Chen

(10) Patent No.: US 10,710,260 B2
(45) Date of Patent: Jul. 14, 2020

(54) WATERMELON CUTTER

(71) Applicant: Pian Chen, Guangdong (CN)

(72) Inventor: Pian Chen, Guangdong (CN)

( * ) Notice: Subject to any disclaimer, the term of this patent is extended or adjusted under 35 U.S.C. 154(b) by 0 days.

(21) Appl. No.: 16/513,728

(22) Filed: Jul. 17, 2019

(65) Prior Publication Data

US 2020/0023536 A1 Jan. 23, 2020

(30) Foreign Application Priority Data

Jul. 19, 2018 (CN) ..... 2018 2 1143304 U

(51) Int. Cl.
*B26D 3/26* (2006.01)

(52) U.S. Cl.
CPC ..... *B26D 3/26* (2013.01)

(58) Field of Classification Search
CPC .... B26D 3/00; B26D 3/24; B26D 3/26; B26B 5/00; B26B 5/008
USPC ..... 30/114, 303, 306; 99/537, 538
See application file for complete search history.

(56) References Cited

U.S. PATENT DOCUMENTS 1,098,747 A * 6/1914 Meyer ..... A21C 11/106 30/306
1,727,747 A * 9/1929 Carney ..... A21C 11/106 30/306
2,487,597 A * 11/1949 Sampson ..... A47J 43/25 241/280
2,818,645 A * 1/1958 Martin ..... A21C 11/106 30/306
2,912,757 A * 11/1959 Knight ..... A47J 17/00 30/303
3,186,362 A * 6/1965 Iannuzzi ..... A21C 9/068 425/298
3,501,801 A * 3/1970 La Fleur ..... A22C 9/008 452/145
3,907,215 A * 9/1975 Mantelet ..... A47J 42/24 241/88.4
4,055,892 A * 11/1977 Del Vecchio ..... B26D 3/185 30/303
4,365,415 A * 12/1982 Pustoch ..... A47J 17/04 30/114
D276,202 S * 11/1984 Shun ..... D7/383
4,553,325 A * 11/1985 Allahverdian ..... A47G 21/045 30/114
4,589,206 A * 5/1986 Marcoux ..... A21C 15/04 30/114
4,625,404 A * 12/1986 Valente ..... A21C 11/106 30/114
4,928,893 A * 5/1990 Prindle ..... A47J 43/25 241/95

(Continued)

*Primary Examiner* — Jason Daniel Prone
*Assistant Examiner* — Richard D Crosby, Jr.
(74) *Attorney, Agent, or Firm* — JCIP Global Inc.

(57) ABSTRACT

The present invention discloses a watermelon cutter including a handle and a cutter, wherein a front end of the handle is connected with a storage device; a front end of the storage device is provided with a cutting opening, and the cutter includes a plurality of blades; the plurality of blades is arranged in a divergently manner and rotatably mounted in the cutting opening; the plurality of blades of the cutter is arranged such that one of the plurality of blades is driven by a pulp to drive the cutter to rotate when the pulp enters into the cutting opening, and the pulp is cut out by another one of the plurality of blades when the cutter is rotated.

6 Claims, 2 Drawing Sheets

(56) References Cited

U.S. PATENT DOCUMENTS

D343,098 S * 1/1994 Shun ..... A47J 43/25 D7/678
5,499,578 A * 3/1996 Payne ..... A47J 43/18 30/114
5,660,341 A * 8/1997 Perkins ..... A47J 43/255 241/169.1
5,803,378 A * 9/1998 Wolters ..... A47J 43/255 241/100
5,903,981 A * 5/1999 Grow, II ..... A47G 21/045 30/114
6,009,786 A * 1/2000 Hjelden ..... A21C 15/04 30/114
6,123,972 A * 9/2000 Matthews ..... A22C 7/00 30/114
6,464,156 B1 * 10/2002 Wexell ..... A22C 17/06 241/169.1
6,606,939 B1 * 8/2003 Tateno ..... A47J 19/02 99/510
D493,074 S * 7/2004 Brousseau ..... D7/678
8,146,468 B1 * 4/2012 Kachelries ..... B26D 1/553 30/117
2005/0005782 A1 * 1/2005 Krupa ..... A21C 15/04 99/537
2006/0010691 A1 * 1/2006 Kaposi ..... A47J 9/005 30/114
2007/0294898 A1 * 12/2007 Beltran ..... B26B 5/008 30/307
2008/0116306 A1 * 5/2008 Ko ..... A47J 43/255 241/93
2008/0302892 A1 * 12/2008 Mah ..... A47J 43/082 241/94
2011/0197452 A1 * 8/2011 So ..... A47J 36/34 30/123
2011/0200729 A1 * 8/2011 Caswell ..... A47J 43/288 426/518
2012/0227564 A1 * 9/2012 Fung ..... A47J 43/25 83/856
2013/0270376 A1 * 10/2013 Hawker ..... A47J 43/25 241/101.1
2014/0158800 A1 * 6/2014 Bordes ..... A47J 43/255 241/278.2
2016/0073828 A1 * 3/2016 Leman ..... A47J 45/07 241/95
2016/0302620 A1 * 10/2016 Repac ..... A47J 43/25
2019/0291291 A1 * 9/2019 Shengli ..... B26D 3/283
2020/0107678 A1 * 4/2020 Koeng ..... B65D 85/76

* cited by examiner

WATERMELON CUTTER

CROSS-REFERENCE TO RELATED APPLICATION

This application claims the priority benefit of China application serial no. 201821143304.3, filed on Jul. 19, 2018. The entirety of the above-mentioned patent application is hereby incorporated by reference herein and made a part of this specification.

BACKGROUND

Technical Field

The present invention relates to a watermelon cutter.

Description of Related Art

People often need to use a cutter when cutting watermelon, cantaloupe and other large-sized fruits. At present, when people consume watermelon or cantaloupe, they usually use an common cutter to cut the watermelon or cantaloupe into four pieces in the horizontal and vertical directions. Then the four pieces of watermelon are cut horizontally or vertically into smaller pieces for convenient consumption. However, when making fruit platter, smaller pieces of pulp are often needed. When the watermelon pulp or cantaloupe pulp is cutting into small pieces by a conventional cutter, it is necessary to operate the cutter for many times of cutting movements to complete the cutting, which is time consuming and laborious. Especially in some restaurants, the size of each piece of pulp is also relatively strict, which is more time consuming and laborious.

SUMMARY

One purpose of the present invention is to solve the above-mentioned problems, and to provide a watermelon cutter which can quickly cut a pulp of a fruit with a relatively large volume, such as the pulp of watermelon or cantaloupe, into small pieces which have substantially the same shape and size.

The present invention provides a watermelon cutter including a handle and a cutter, wherein a front end of the handle is connected with a storage device; a front end of the storage device is provided with a cutting opening, and the cutter includes a plurality of blades; the plurality of blades is arranged in a divergent manner and rotatably mounted in the cutting opening; the blades of the cutter are arranged such that one of the blades is driven by a pulp to drive the cutter to rotate when the pulp enters into the cutting opening, and the pulp is cut out by another of the blades when the cutter is rotated.

In the above technical solution, when the cutting opening of the storage device is operated to be pushed toward the pulp by holding the handle, the pulp is utilized to push the cutter to rotate and then the pulp is cut out by the cutter, which saves time and labor. The forming of the block-shaped pulp has fast speed, and the formed pulp can also be stored in the storage device. And the pulp can be poured out after storage device is full, which keeps the pulp clean.

Preferably, a rotation shaft is mounted in the cutting opening, and the cutter further includes a shaft sleeve; the plurality of blades centering on an axis of the shaft sleeve are arranged in a divergently manner on the shaft sleeve; the shaft sleeve is sleeved on the rotation shaft; the cutter is rotatably mounted in the cutting opening by the rotation shaft passing through the shaft sleeve.

Preferably, the storage device includes a bottom plate, and a left side plate and a right side plate respectively disposed on both sides of the bottom plate; the bottom plate, the left side plate and the right side plate can be collectively enclosed together to form a storage groove that allows the pulp entered into the cutting opening to slide; a front end surface of the bottom plate and front end surfaces of the left side plate and of the right side plate can be collectively enclosed together to form the cutting opening. The storage device in the technical solution has a simple structure, and is relatively practical. The storage device in the technical solution also has a relatively low manufacturing cost, and the product is relatively easy to be popularized.

Preferably, upper side surfaces of front ends of the left side plate and of the right side plate respectively extend with a left mounting arm and a right mounting arm, and front end surfaces of the left mounting arm and of the right mounting arm are flush with the front end faces of the left side plate and of the right side plate, respectively, and the cutter is disposed between the left mounting arm and the right mounting arm. In this technical solution, the mounting arms are formed by side plate extensions, which ensures that inner surfaces of the mounting arms are flush with inner surfaces of the side plates, reduces the resistance of the pulp entering into the cutting opening, and maintains the integrity of the pulp.

Preferably, the bottom plate is provided with venting through holes. In the technical solution, the venting through holes may reduce the viscosity between the watermelon pulp and the bottom plate, and facilitate the pouring of the pulp.

Preferably, the blade has a first major surface and a second major surface, and the first major surface and the second major surface are each curved to the same side to form a curved surface, the concave surface of the curved surface is arranged to face the cutting opening when the cutter is rotated to cut the pulp. The watermelon pulp can be better cut out and the deformation range of the watermelon pulp can be reduced as much as possible and the loss of watermelon pulp juice is reduced, due to the configuration of the blades in the technical solution.

The advantages of the present invention are that it has a simple structure and convenient operation, and that it can cut the pulp into pieces quickly and conveniently, saving the user's time, and that the pulp can be utilized to push the cutter to rotate and then the pulp is cut out to form a block shape by the cutter, simply by holding the handle to operate and push the cutting opening of the storage device toward the pulp.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

The present invention will be further described in detail below with reference to the accompanying drawings.

Figure 1:
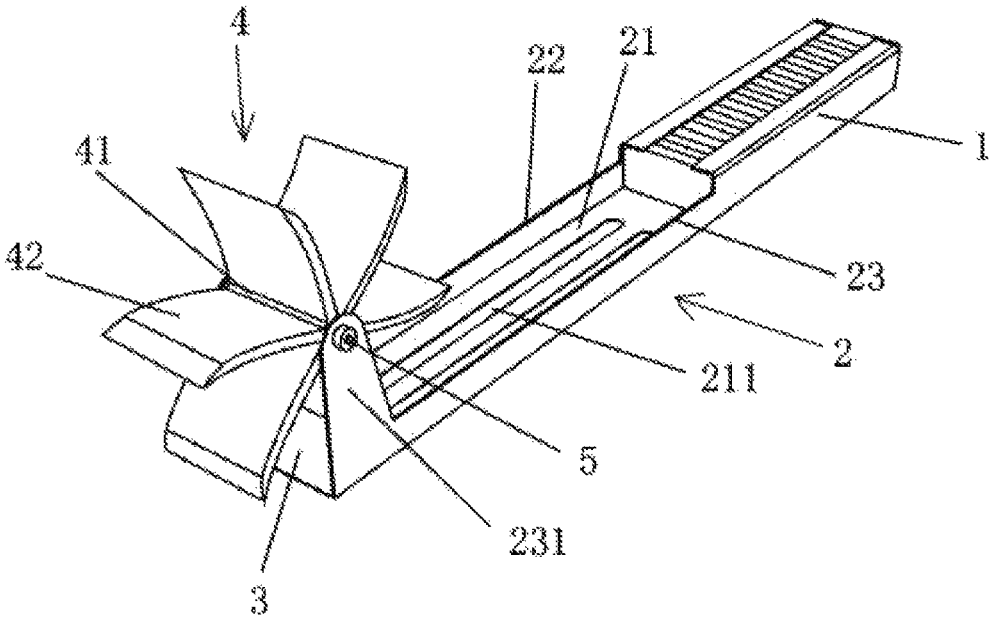
FIG. 1 is a schematic view of a three-dimensional structure of a watermelon cutter according to the present invention.

As shown in FIG. 1, the present invention relates to a watermelon cutter including a handle 1 and a cutter 4. A front end of the handle 1 is connected with a storage device 2. A front end of the storage device 2 is provided with a cutting opening 3. The storage device 2 includes a bottom plate 21, and a left side plate 22 and a right side plate 23 respectively disposed on both sides of the bottom plate 21. The bottom plate 21, the left side plate 22 and the right side plate 23 can be collectively enclosed together to form a storage groove that allows the pulp entered into the cutting opening 3 to slide. A front end surface of the bottom plate 21 and front end surfaces of the left side plate 22 and of the right side plate 23 can be collectively enclosed together to form the cutting opening 3, wherein a handle housing and the storage device 2 are integrally formed by stamping a stainless steel sheet, and the handle housing is filled with a plastic material to form the handle 1.

Figure 2:
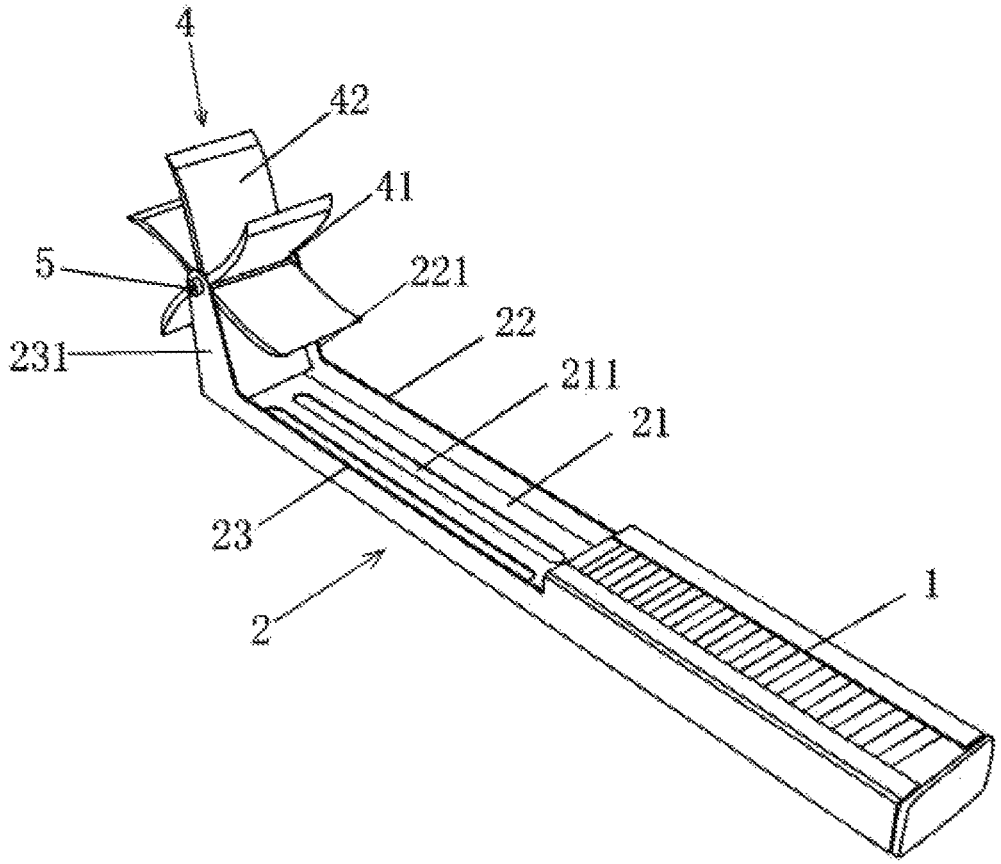
FIG. 2 is a schematic view of the three-dimensional structure of a watermelon cutter according to the present invention.

As shown in FIG. 1 and FIG. 2, as a further improvement, upper side surfaces of front ends of the left side plate 22 and of the right side plate 23 respectively extend with a left mounting arm 221 and a right mounting arm 231, and front end surfaces of the left mounting arm 221 and the right mounting arm 231 are flush with the front end faces of the left side plate 22 and the right side plate 23, respectively, and the cutter 4 is disposed between the left mounting arm 221 and the right mounting arm 231. The mounting arms is formed by side plate extensions, which ensures that inner surfaces of the mounting arms are flush with inner surfaces of the side plates, reduces the resistance of the pulp entering into the cutting opening 3, and maintains the integrity of the pulp.

As a further improvement, the bottom plate 21 are provided with venting through holes 211 to reduce the viscosity between the pulp and the bottom plate 21 and facilitate the pouring of the pulp.

As shown in FIG. 1, in the embodiment provided by the present invention, the cutter 4 includes a shaft sleeve 41 and a plurality of blades 42. The plurality of blades 42 centering on an axis of the shaft sleeve 41 are arranged in a divergent manner on the shaft sleeve 41. In the present embodiment, the number of the blades 42 is six. The six blades 42 and the shaft sleeve 41 constitute a windmill shape. The cutter 4 is rotatably mounted in the cutting opening 3 by a rotation shaft 5 passing through the shaft sleeve 41. When the pulp enters into the cutting opening 3, the pulp pushes one of the blades 42 to drive the cutter 4 to rotate counterclockwise. During the rotation of the cutter 4, another blade 42 adjacent to the pushed blade 42 will cut out the pulp and push the pulp into the storage groove, with the rotation of the cutter 4. During the advancement of the cutting opening 3 toward the pulp, the pulp pushes the blade 42 to drive the cutter 4 to rotate, and the blade 42 of the cutter 4 cuts out the pulp and pushes the pulp into the storage groove. This process will continue automatically until the cutting opening 3 stops advancing toward the pulp.

As shown in FIG. 1 and FIG. 2, as a further improvement, the blade 42 has a first major surface and a second major surface, and the first major surface and the second major surface are each curved to the same side to form a curved surface. The concave surface of the curved surface is arranged to face the cutting opening 3 when the cutter 4 is rotated to cut the pulp. The watermelon pulp can be better cut out and the deformation range of the watermelon pulp, cantaloupe pulp or other fruit pulps can be reduced as much as possible and the loss of watermelon pulp juice is reduced, due to the configuration of the blade 42.

The embodiments of the present invention described above are not intended to limit the scope of the present invention. Any modifications, equivalent substitutions and improvements made within the spirit of the invention are intended to be included within the protection scope of the claims of the invention.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A watermelon cutter comprising a handle and a cutter, wherein a front end of the handle is connected with a storage device, a front end of the storage device is provided with a cutting opening, and the cutter comprises a plurality of blades, the plurality of blades is arranged in a divergently manner and rotatably mounted in the cutting opening, the plurality of blades of the cutter is arranged such that one of the plurality of blades is driven by a pulp to drive the cutter to rotate when the pulp enters into the cutting opening, and the pulp is cut out by another one of the plurality of blades when the cutter is rotated.

2. The watermelon cutter according to claim 1, wherein a rotation shaft is mounted in the cutting opening, and the cutter further comprises a shaft sleeve; the plurality of blades centering on an axis of the shaft sleeve are arranged in a divergently manner on the shaft sleeve; the shaft sleeve is sleeved on the rotation shaft; the cutter is rotatably mounted in the cutting opening by the rotation shaft passing through the shaft sleeve.

3. The watermelon cutter according to claim 1, wherein the storage device includes a bottom plate, and a left side plate and a right side plate respectively disposed on both sides of the bottom plate; the bottom plate, the left side plate and the right side plate are collectively enclosed together to form a storage groove that allows the pulp entered into the cutting opening to slide, a front end surface of the bottom plate and front end surfaces of the left side plate and of the right side plate are collectively enclosed together to form the cutting opening.

4. The watermelon cutter according to claim 3, wherein upper side surfaces of front ends of the left side plate and of the right side plate respectively extend with a left mounting arm and a right mounting arm, and front end surfaces of the left mounting arm and of the right mounting arm are flush with the front end faces of the left side plate and of the right side plate, respectively, and the cutter is disposed between the left mounting arm and the right mounting arm.

5. The watermelon cutter according to claim 3, wherein the bottom plate is provided with venting through holes.

6. The watermelon cutter according to claim 1, wherein the blade has a first major surface and a second major surface, and the first major surface and the second major surface are each curved to the same side to form a curved surface, the concave surface of the curved surface is arranged to face the cutting opening when the cutter is rotated to cut the pulp.

* * * * *